US007291047B1

(12) United States Patent
Jones et al.

(10) Patent No.: US 7,291,047 B1
(45) Date of Patent: Nov. 6, 2007

(54) PROTECTIVE CASING FOR WATER CRAFT PROPELLERS

(76) Inventors: Roy Jones, 7145 C.R. 605, Dayton, TX (US) 77353; Amy Jones, 7145 C.R. 605, Dayton, TX (US) 77353

( * ) Notice: Subject to any disclaimer, the term of this patent is extended or adjusted under 35 U.S.C. 154(b) by 0 days.

(21) Appl. No.: 11/496,796

(22) Filed: Aug. 1, 2006

Related U.S. Application Data

(60) Provisional application No. 60/704,150, filed on Aug. 1, 2005.

(51) Int. Cl.
*B63H 5/16* (2006.01)

(52) U.S. Cl. ..... 440/71; 416/247 A

(58) Field of Classification Search ..... 440/71; 416/247 A
See application file for complete search history.

(56) References Cited

U.S. PATENT DOCUMENTS

D263,555 S 3/1982 Curtis
4,893,487 A 1/1990 Johnson
5,246,345 A * 9/1993 Adams, Jr. ..... 416/247 A
5,417,093 A * 5/1995 Heiberg ..... 70/232
5,540,067 A * 7/1996 Kim ..... 70/209
D386,466 S 11/1997 Hanson

* cited by examiner

*Primary Examiner*—Lars A. Olson
*Assistant Examiner*—Daniel V Venne

(57) ABSTRACT

A shielding apparatus includes a body formed from rigid material that has first and second pivotally conjoined sections removably cradled about the propeller. The body has a fulcrum axis registered parallel to a longitudinal length of the propeller. Each of the sections includes a plurality of cylindrical sleeves linearly juxtaposed end-to-end when the sections are adapted to the closed position. The sleeves receive the locking mechanism therethrough and prevent the first and second sections from pivoting to the open position. A fastener is included for locking the sections together at the closed position. The locking fastener is telescopically interfitted through corresponding distal ends of the sections. The locking fastener is detachable from the body when withdrawn along a linear plane extending parallel to the fulcrum axis such that the locking mechanism remains spaced from the propeller. The locking fastener is coplanar with the fulcrum axis.

15 Claims, 5 Drawing Sheets

PROTECTIVE CASING FOR WATER CRAFT PROPELLERS

CROSS REFERENCE TO RELATED APPLICATIONS

This application claims the benefit of U.S. Provisional Application No. 60/704,150, filed Aug. 1, 2005.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to protective casings and, more particularly, to a protective casing for water craft propellers for covering a water vehicle propeller during non-operating conditions.

2. Prior Art

Boat propellers are utilized within a boat (inboard, outboard and inboard/outboard) for driving the boat forwardly and rearwardly. Boat propellers have a plurality of blades that are balanced to create an optimal performance when in the water. The propeller blades are easily damaged when the boat is removed from the water (e.g. engaging the ground, objects, etc.). In addition, the propeller blades can cause significant injury to individuals that make contact with the propeller.

One prior art example shows a boat propeller shield system that includes a cover, a front opening within the cover and a zipper extending from a perimeter of the front opening. The cover is preferably constructed of a resilient material such as neoprene. Drawbacks to this system include being constructed of neoprene material that may be torn or cut, and a zipper which may become defective or clogged with dirt, debris, etc., and therefore useless for its intended purpose.

Another prior art example shows a protective propeller cover system that includes a flexible sleeve into which buoyant material is placed to provide a buoyant enclosure. A flexible propeller cover portion is secured to the flexible sleeve, and the distal end is releasably secured about the propeller. The buoyant enclosure is positioned adjacent to the propeller and is sized to extend above the water line when the propeller is positioned beneath the water line. The buoyant enclosure serves to protect swimmers from direct contact with the propeller when swimming in proximity to the boat. The protective propeller cover apparatus further serves to protect the propeller during transport or storage.

This prior art example is difficult to attach and is cumbersome to use. In addition, this example has a plurality of parts that must be used together, increasing the likelihood that parts will become lost or damaged. Another drawback to such a system is the need for some kind of flotation material to be inserted into the flexible sleeve, which may be costly or difficult to obtain. Also, the flexible material may be torn or cut, thus rendering the system useless for its intended purpose.

Accordingly, a need remains for a protective casing for water craft propellers in order to overcome the above-noted shortcomings. The present invention satisfies such a need by providing an apparatus that is easy to install, tamper proof, corrosion resistant, and inexpensive. Such an apparatus can be locked into place, and would effectively prevent the theft of boat propellers, or help prevent damage to propellers during shipping or transport, or when being docked or mounted on a trailer. The apparatus will also advantageously protect swimmers from injury when making contact with the propeller.

BRIEF SUMMARY OF THE INVENTION

In view of the foregoing background, it is therefore an object of the present invention to provide an apparatus for a protective casing for water craft propellers. These and other objects, features, and advantages of the invention are provided by a shielding apparatus for covering a water vehicle propeller during non-operating conditions.

The shielding apparatus includes a body conveniently formed from rigid material that has first and second pivotally conjoined sections removably cradled about the propeller such that the propeller becomes advantageously housed inside the body when the first and second sections are articulated to a closed position, thereby effectively preventing unauthorized access to a major portion of the propeller. Such a body has a fulcrum axis registered parallel to a longitudinal length of the propeller. Each of the first and second sections includes a plurality of cylindrical sleeves linearly juxtaposed end-to-end when the first and second sections are adapted to the closed position. The sleeves conveniently receive the locking mechanism therethrough and effectively prevent the first and second sections from pivoting to the open position.

The first and second sections may be provided with a respective linear rear edge contiguously laying directly against each other when the first and second sections are pivoted to the closed position. Such rear edges are oriented orthogonal to the fulcrum axis. The first and second sections preferably include front edges conveniently provided with coextensively shaped arcuate regions directly adjoined about the propeller such that the propeller becomes effectively intercalated between the respective arcuate regions when the first and second sections are articulated to the closed position. Such arcuate regions converge rearwardly along the longitudinal length of the propeller and define a funnel shape terminating at a proximal end of the propeller. The first and second sections cover the entire longitudinal length of the propeller when said first and second sections are biased to the closed position. The apparatus preferably also includes arcuate regions that are monolithically formed with said first and second sections and are coextensively shaped such that said arcuate regions uniformly fit about the propeller, said arcuate regions extending rearwardly from an outer surface of said first and second regions and being oppositely spaced from a front end of said body.

The second section may also be provided with a stop member monolithically formed with the front edge thereof. Such a stop member extends vertically upward from the front edge of the second section and effectively engages the first section when the sections are biased to the closed position. The stop member has an inner shoulder directly and conveniently mated with the locking mechanism such that the locking mechanism is effectively prohibited from passing beyond the front edges of the first and second sections respectively.

A fastener is included for effectively locking the first and second sections together at the closed position. Such a locking fastener is telescopically interfitted through corresponding distal ends of the first and second sections. The locking fastener is conveniently detachable from the body when withdrawn along a linear plane extending parallel to the fulcrum axis such that the locking fastener remains advantageously spaced from the propeller. The locking fastener is coplanar with the fulcrum axis. The locking fastener may include a convenient linear quick-release pin with a longitudinal length greater than a width of the body so that a tip of the pin remains advantageously exposed exterior of the second section during the closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
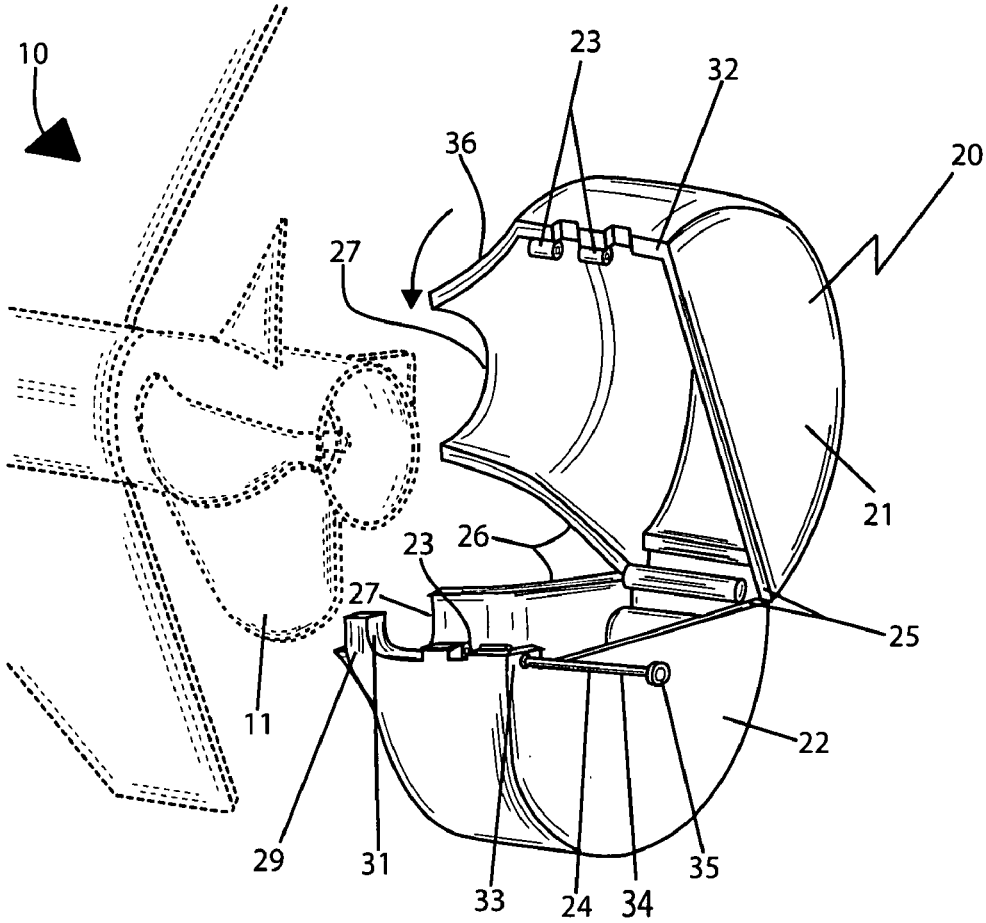
FIG. 1 is a perspective view showing a protective casing for water craft propellers, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a protective casing for water craft propellers. It should be understood that the apparatus 10 may be used to protect many different types of water craft propellers and should not be limited to any one type of propeller.

Referring initially to FIGS. 1, 2, 3, 4, and 5, the apparatus 10 includes a body 20 conveniently formed from rigid material that has first 21 and second 22 pivotally conjoined sections removably cradled about the propeller 11 such that the propeller 11 advantageously becomes housed inside the body 20 when the first 21 and second 22 sections are articulated to a closed position, thereby effectively preventing unauthorized access to a major portion of the propeller 11. Of course, such rigid material may include hard plastic, steel, aluminum or any other suitable non-corrosive material, as is obvious to a person of ordinary skill in the art.

Figure 2:
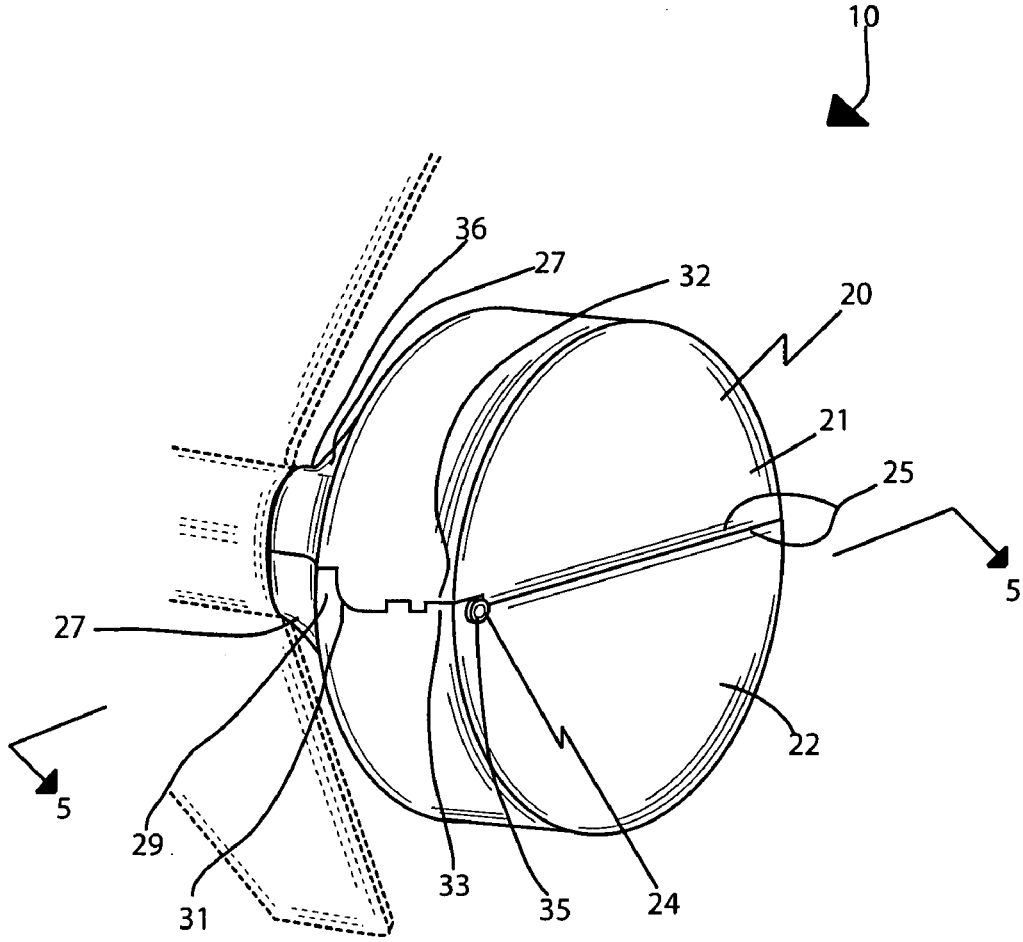
FIG. 2 is a perspective view showing the apparatus of FIG. 1 at a closed position.
Figure 3:
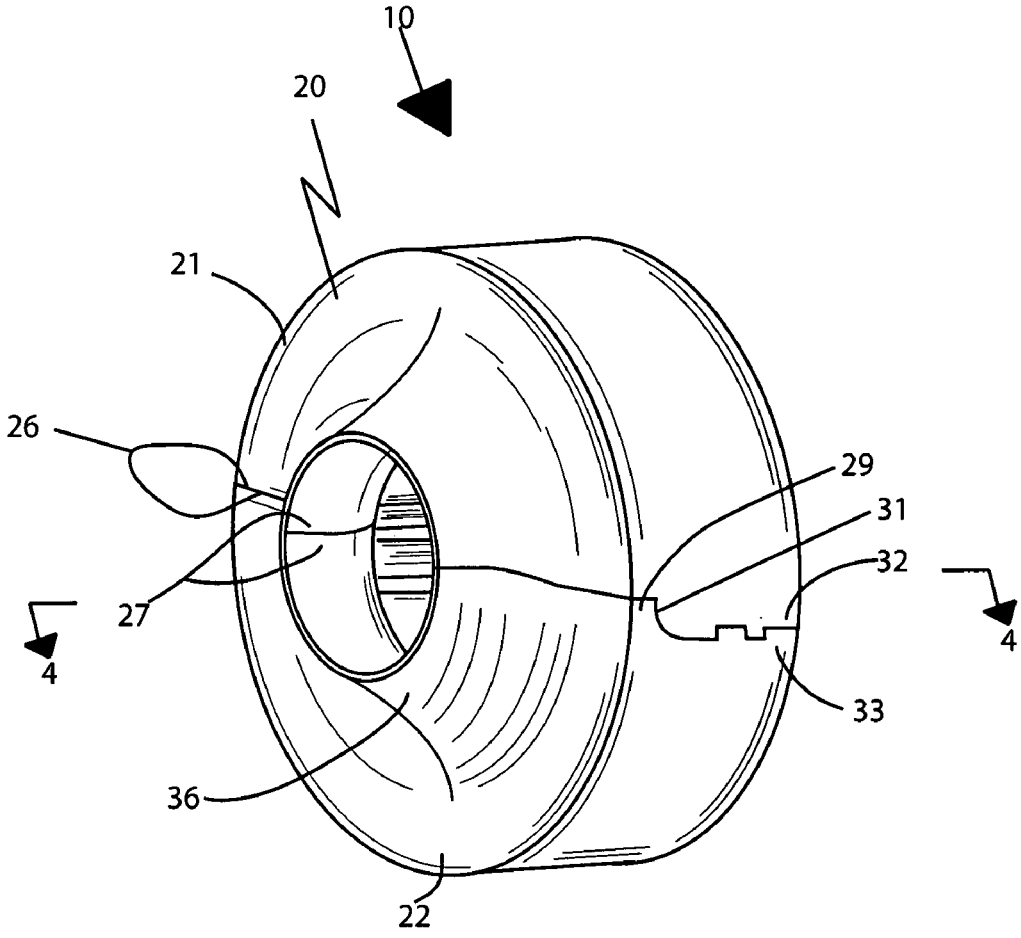
FIG. 3 is a rear perspective view of the apparatus shown in FIG. 1.
Figure 4:
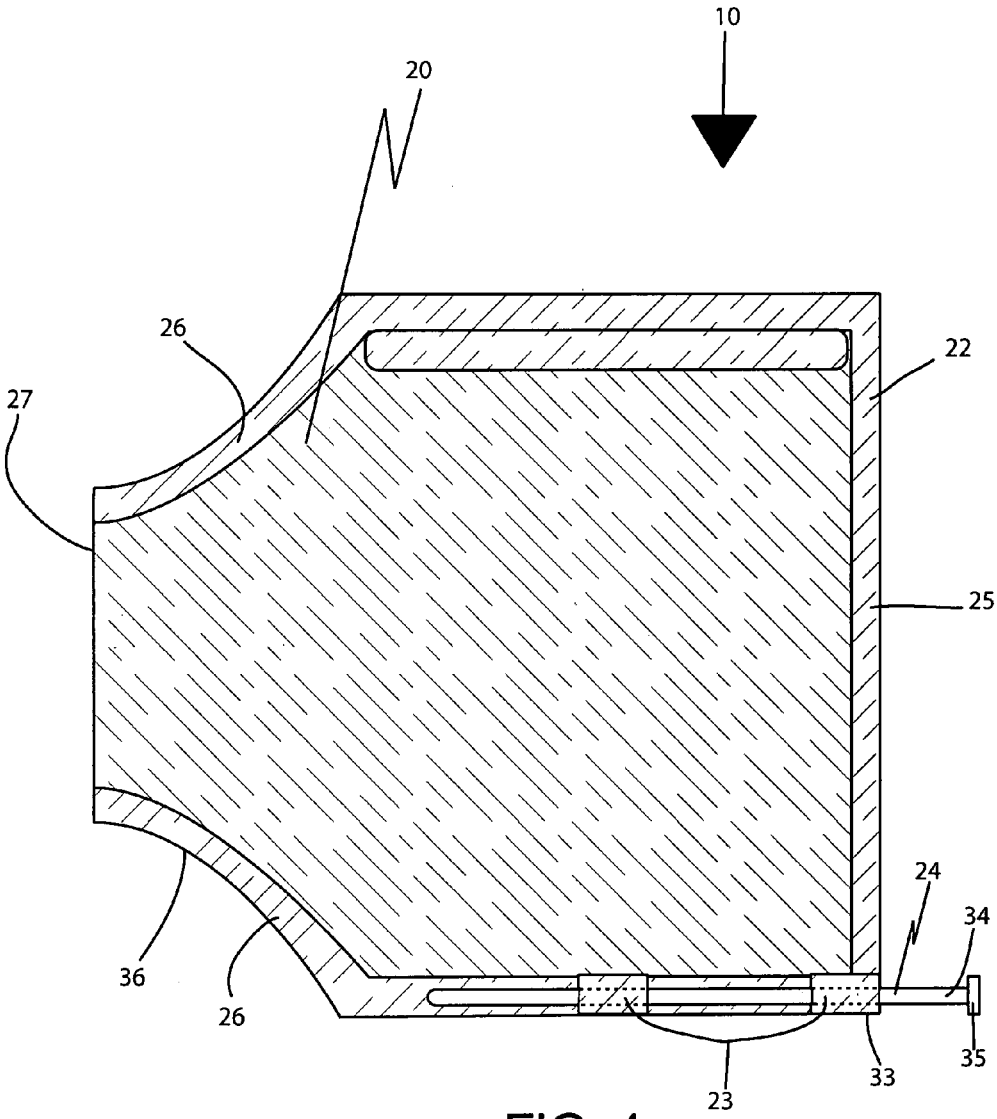
FIG. 4 is a cross-sectional view of the apparatus shown in FIG. 3 taken along line 4-4.
Figure 5:
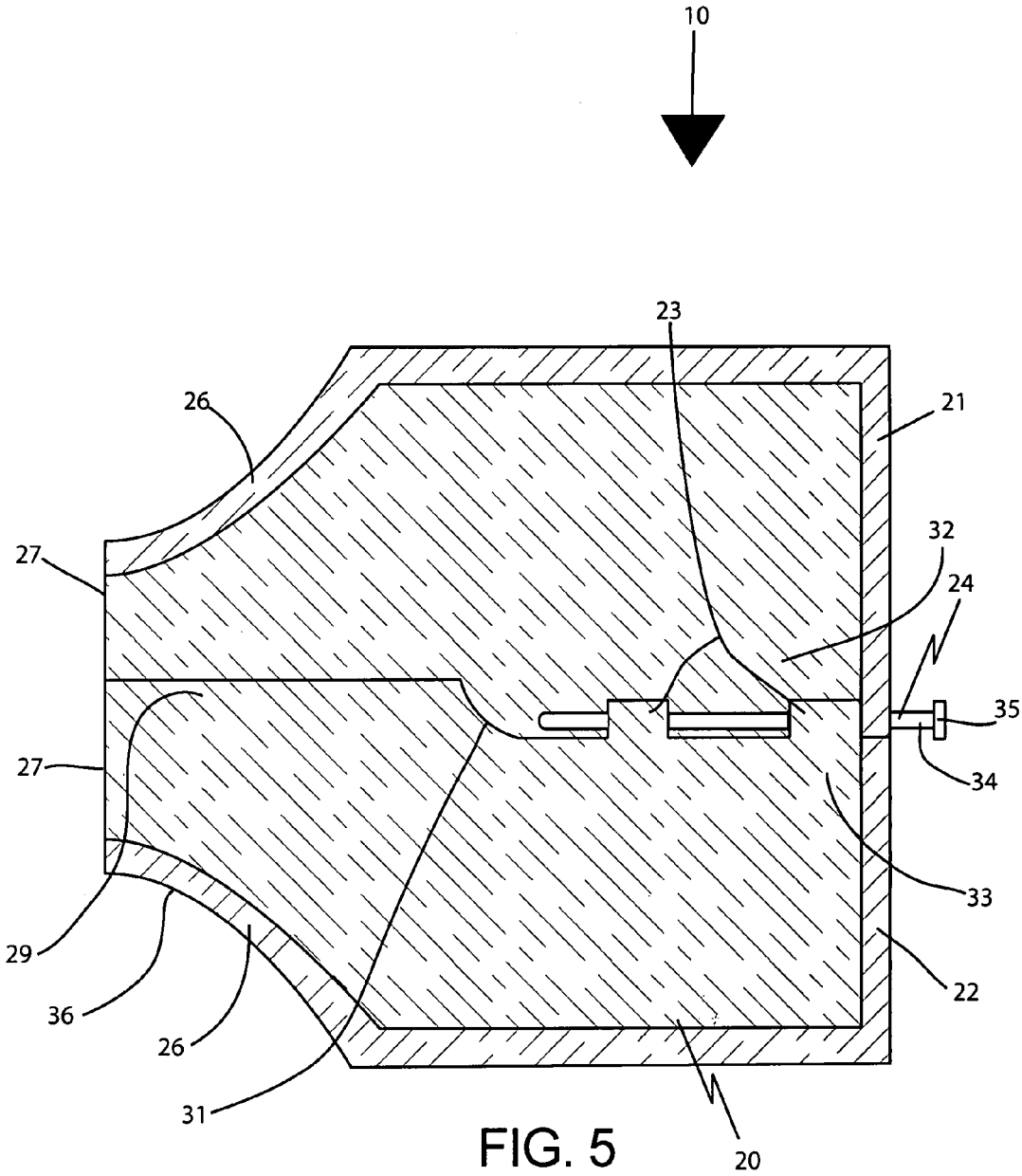
FIG. 5 is a cross-sectional view of the apparatus shown in FIG. 4 taken along line 5-5.

Such a body 20 has a fulcrum axis registered parallel to a longitudinal length of the propeller 11. Each of the first 21 and second 22 sections includes a plurality of cylindrical sleeves 23 linearly juxtaposed end-to-end when the first 21 and second 22 sections are adapted to the closed position, as is best shown in FIGS. 1 and 2. The sleeves 23 conveniently receive the locking mechanism 24 therethrough and effectively prevent the first 21 and second 22 sections from pivoting to the open position, which is crucial to preventing unauthorized access to the propeller 11.

Again referring to FIGS. 1 through 5, the first 21 and second 22 sections are provided with a respective linear rear 25 edge contiguously laying directly against each other, without the use of intervening elements, when the first 21 and second 22 sections are pivoted to the closed position. Such rear edges 25 are oriented orthogonal to the fulcrum axis, which is critical for advantageously providing a uniform and symmetrically oriented opening when the first and second sections 21, 22 are biased to the open position.

The first 21 and second 22 sections further include front edges 26 conveniently provided with coextensively shaped arcuate regions 27 directly adjoined about the propeller 11, without the use of intervening elements, such that the propeller 11 advantageously becomes intercalated between the respective arcuate regions 27 when the first 21 and second 22 sections are articulated to the closed position, which is vital for protection of the propeller 11 while encased within the apparatus 10.

The apparatus 10 preferably also includes arcuate regions 27 that are monolithically formed with said first 21 and second 22 sections and are coextensively shaped such that said arcuate regions 27 uniformly fit about the propeller 11, said arcuate regions 27 extending rearwardly from an outer surface of said first 21 and second 22 regions and being oppositely spaced from a front end 26 of said body 20. Such arcuate regions 27 converge rearwardly along the longitudinal length of the propeller 11 and define a funnel shape 36 terminating at a proximal end of the propeller 11. The first 21 and second 22 sections cover the entire longitudinal length of the propeller 11 when said first 21 and second 22 sections are biased to the closed position. The rearwardly converging shape of the arcuate regions 27 is critical for providing a snug fit about conventional cylindrical shafts of the propeller 11. If the arcuate regions 27 did not have such a rearwardly flanging shape, an authorized person may be able to pry open the first and second sections 21, 22 and access the propeller 11.

Still referring to FIGS. 1 through 5, the second section 22 is provided with a stop member 29 monolithically formed with the front edge 26 thereof. Such a stop member extends vertically upward from the front edge 26 of the second section 22 and effectively engages the first section 21 when the sections 21, 22 are biased to the closed position. The stop member 29 has an inner shoulder 31 directly and conveniently mated, without the use of intervening elements, with the locking mechanism 24 such that the locking mechanism 24 is effectively prohibited from passing beyond the front edges 26 of the first 21 and second 22 sections respectively.

Yet again referring to FIGS. 1 through 5, a fastener 24 is included for effectively locking the first 21 and second 22 sections together at the closed position. Such a locking fastener 24 is telescopically interfitted through corresponding distal ends 32, 33 of the first 21 and second 22 sections. The present invention 10 critically includes a key-actuated fastener 24 typically employed by vending machines wherein an authorized user inserts a key therein, which is unique to a lock of the fastener 24 for accessing the propeller. The fastener 24 is also spring-actuated wherein the user pushes the fastener 24 into the body until it clicks such that the fastener 24 lays flush against the body 20 during transport operations.

The locking fastener 24 is conveniently detachable from the body 20 when withdrawn along a linear plane extending parallel to the fulcrum axis such that the locking fastener 24 remains advantageously spaced from the propeller 11. The locking fastener 24 is coplanar with the fulcrum axis. The locking fastener 24 includes a convenient linear quick-release pin 34 with a longitudinal length greater than a width of the body 20 so that a tip 35 of the pin 34 advantageously remains exposed to an exterior of the second section 22 during the closed position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A shielding apparatus for covering a water vehicle propeller during non-operating conditions, said shielding apparatus comprising:

a body formed from rigid material and having first and second pivotally conjoined sections removably cradled about the propeller such that the propeller becomes housed inside said body when said first and second sections are articulated to a closed position and thereby preventing unauthorized access to a major portion of the propeller, said body having a fulcrum axis registered parallel to a longitudinal length of the propeller; and means for locking said first and second sections together at the closed position, said locking means being telescopically interfitted through corresponding distal ends of said first and second sections, said locking means being detachable from said body when withdrawn along a linear plane extending parallel to said fulcrum axis such that said locking means remains spaced from the propeller;

wherein said first and second sections cover the entire longitudinal length of the propeller when said first and second sections are biased to the closed position;

wherein each of said first and second sections are provided with a respective linear rear edge contiguously laying directly against each other when said first and second sections are pivoted to the closed position, said rear edges being oriented orthogonal to the fulcrum axis.

2. The apparatus of claim 1, wherein each of said first and second sections includes front edges provided with coextensively shaped arcuate regions directly adjoined about the propeller such that the propeller becomes intercalated between said respective arcuate regions when said first and second sections are articulated to the closed position, said arcuate regions converging rearwardly along the longitudinal length of the propeller and defining a funnel shape terminating at a proximal end of the propeller.

3. The apparatus of claim 2, wherein said arcuate regions are monolithically formed with said first and second sections and are coextensively shaped such that said arcuate regions uniformly fit about the propeller, said arcuate regions extending rearwardly from an outer surface of said first and second regions and being oppositely spaced from a front end of said body.

4. The apparatus of claim 1, wherein said locking means comprises: a linear quick-release pin having a longitudinal length greater than a width of said body so that a tip of said pin remains exposed exterior of said second section during the closed position.

5. The apparatus of claim 3, wherein said second section is provided with a stop member monolithically formed with said front edge thereof, said stop member extending vertically upward from said front edge and being engaged with said tab when said first and second sections are biased to the closed position, said stop member having a inner shoulder directly mated with said locking means such that said locking means is prohibited from passing beyond said front edges of said first and second sections respectively.

6. A shielding apparatus for covering a water vehicle propeller during non-operating conditions, said shielding apparatus comprising:

a body formed from rigid material and having first and second pivotally conjoined sections removably cradled about the propeller such that the propeller becomes housed inside said body when said first and second sections are articulated to a closed position and thereby preventing unauthorized access to a major portion of the propeller, said body having a fulcrum axis registered parallel to a longitudinal length of the propeller, wherein each of said first and second sections include a plurality of cylindrical sleeves linearly juxtaposed end-to-end when said first and second sections are adapted to the closed position, said sleeves receiving said locking means therethrough and preventing said first and second sections from pivoting to the open position; and means for locking said first and second sections together at the closed position, said locking means being telescopically interfitted through corresponding distal ends of said first and second sections, said locking means being detachable from said body when withdrawn along a linear plane extending parallel to said fulcrum axis such that said locking means remains spaced from the propeller;

wherein said first and second sections cover the entire longitudinal length of the propeller when said first and second sections are biased to the closed position;

wherein each of said first and second sections are provided with a respective linear rear edge contiguously laying directly against each other when said first and second sections are pivoted to the closed position, said rear edges being oriented orthogonal to the fulcrum axis, said arcuate regions converging rearwardly along the longitudinal length of the propeller and defining a funnel shape terminating at a proximal end of the propeller.

7. The apparatus of claim 6, wherein each of said first and second sections include front edges provided with coextensively shaped arcuate regions directly adjoined about the propeller such that the propeller becomes intercalated between said respective arcuate regions when said first and second sections are articulated to the closed position.

8. The apparatus of claim 7, wherein said arcuate regions are monolithically formed with said first and second sections and are coextensively shaped such that said arcuate regions uniformly fit about the propeller, said arcuate regions extending rearwardly from an outer surface of said first and second regions and being oppositely spaced from a front end of said body.

9. The apparatus of claim 6, wherein said locking means comprises: a linear quick-release pin having a longitudinal length greater than a width of said body so that a tip of said pin remains exposed exterior of said second section during the closed position.

10. The apparatus of claim 8, wherein said second section is provided with a stop member monolithically formed with said front edge thereof, said stop member extending vertically upward from said front edge and being engaged with said tab when said first and second sections are biased to the closed position, said stop member having a inner shoulder directly mated with said locking means such that said locking means is prohibited from passing beyond said front edges of said first and second sections respectively.

11. A shielding apparatus for covering a water vehicle propeller during non-operating conditions, said shielding apparatus comprising:

a body formed from rigid material and having first and second pivotally conjoined sections removably cradled about the propeller such that the propeller becomes housed inside said body when said first and second sections are articulated to a closed position and thereby preventing unauthorized access to a major portion of the propeller, said body having a fulcrum axis registered parallel to a longitudinal length of the propeller, wherein each of said first and second sections include a plurality of cylindrical sleeves linearly juxtaposed end-to-end when said first and second sections are adapted to the closed position, said sleeves receiving said locking means therethrough and preventing said first and second sections from pivoting to the open position; and means for locking said first and second sections together at the closed position, said locking means being telescopically interfitted through corresponding distal ends of said first and second sections, said locking means being detachable from said body when withdrawn along a linear plane extending parallel to said fulcrum axis such that said locking means remains spaced from the propeller, wherein said locking means is coplanar with the fulcrum axis;

wherein said first and second sections cover the entire longitudinal length of the propeller when said first and second sections are biased to the closed position;

wherein each of said first and second sections are provided with a respective linear rear edge contiguously laying directly against each other when said first and second sections are pivoted to the closed position, said rear edges being oriented orthogonal to the fulcrum axis, said arcuate regions converging rearwardly along the longitudinal length of the propeller and defining a funnel shape terminating at a proximal end of the propeller.

12. The apparatus of claim 11, wherein each of said first and second sections includes front edges provided with coextensively shaped arcuate regions directly adjoined about the propeller such that the propeller becomes intercalated between said respective arcuate regions when said first and second sections are articulated to the closed position.

13. The apparatus of claim 12, wherein said arcuate regions are monolithically formed with said first and second sections and are coextensively shaped such that said arcuate regions uniformly fit about the propeller, said arcuate regions extending rearwardly from an outer surface of said first and second regions and being oppositely spaced from a front end of said body.

14. The apparatus of claim 11, wherein said locking means comprises: a linear quick-release pin having a longitudinal length greater than a width of said body so that a tip of said pin remains exposed exterior of said second section during the closed position.

15. The apparatus of claim 13, wherein said second section is provided with a stop member monolithically formed with said front edge thereof, said stop member extending vertically upward from said front edge and being engaged with said tab when said first and second sections are biased to the closed position, said stop member having a inner shoulder directly mated with said locking means such that said locking means is prohibited from passing beyond said front edges of said first and second sections respectively.

* * * * *